US009185979B1

(12) United States Patent
Jenks et al.

(10) Patent No.: US 9,185,979 B1
(45) Date of Patent: Nov. 17, 2015

(54) FLOATING METAL SHELF AND MOUNTING BRACKET

(71) Applicants: Douglas Scott Jenks, Concord, CA (US); Joshua Schletzbaum Fulcher, Concord, CA (US)

(72) Inventors: Douglas Scott Jenks, Concord, CA (US); Joshua Schletzbaum Fulcher, Concord, CA (US)

(73) Assignee: Pilgrim Home and Health Alliance, LLC, Concord, CA (US)

( * ) Notice: Subject to any disclaimer, the term of this patent is extended or adjusted under 35 U.S.C. 154(b) by 0 days.

(21) Appl. No.: 14/695,314

(22) Filed: Apr. 24, 2015

Related U.S. Application Data

(60) Provisional application No. 62/047,402, filed on Sep. 8, 2014.

(51) Int. Cl.
*A47B 23/00* (2006.01)
*A47B 96/02* (2006.01)
*A47B 96/06* (2006.01)

(52) U.S. Cl.
CPC ..... *A47B 96/028* (2013.01); *A47B 96/021* (2013.01); *A47B 96/066* (2013.01)

(58) Field of Classification Search
CPC .... A47B 96/02; A47B 96/024; A47B 96/027; A47B 96/028; A47B 96/06; A47B 96/061; A47B 96/067; A47B 95/008; A47F 5/0846; A47F 5/0853; F16M 13/00
USPC ..... 108/42, 47, 48, 152; 211/87.01, 94.01, 211/90.01, 88.01; 248/220.21, 225.11
See application file for complete search history.

(56) References Cited

U.S. PATENT DOCUMENTS

| | | | | | |
|---|---|---|---|---|---|
| 2,219,975 | A | * | 10/1940 | Bentz | 248/220.1 |
| 2,261,078 | A | * | 10/1941 | Shockey | 108/42 |
| 2,657,811 | A | * | 11/1953 | Isler | 108/42 |
| 3,190,243 | A | * | 6/1965 | Pira | 108/152 |
| 3,381,636 | A | * | 5/1968 | Saiberlich | 108/152 |
| 4,131,203 | A | | 12/1978 | Bridges | |
| 4,215,840 | A | | 8/1980 | Babberl | |
| 4,381,715 | A | * | 5/1983 | Forman | 108/152 |
| 4,441,433 | A | * | 4/1984 | Caldwell | 108/152 |
| 4,542,831 | A | * | 9/1985 | Dazza | 108/42 |

(Continued)

FOREIGN PATENT DOCUMENTS

JP 7255537 A 10/1995

OTHER PUBLICATIONS

Hangman Products; http://hangmanproducts.com/products/professional-french-cleat hanger.

(Continued)

*Primary Examiner* — Jose V Chen
(74) *Attorney, Agent, or Firm* — Charles L. Thoeming

(57) ABSTRACT

An embodiment of a floating shelf and mounting bracket provides two parts, a hollow metal shelf and a bracket. The metal shelf includes five enclosed sides. The metal shelf back side that mounts to a planar surface is partially open creating an integral mounting tab surface that allows the metal shelf to simply be lowered onto an offset upward bend of the mounting bracket that is attached to the planar surface, providing a quick and secure mounting method of the shelf without any visible brackets or hardware. An alternate embodiment includes notched openings in the metal shelf back side sized to receive and engage spacer posts on the mounting bracket upward bend for further lateral shelf stability.

8 Claims, 2 Drawing Sheets

(56) References Cited

U.S. PATENT DOCUMENTS

| | | | | |
|---|---|---|---|---|
| 4,843,977 | A | 7/1989 | Bridges | |
| 5,044,285 | A * | 9/1991 | Wolfe, III | 108/152 |
| 5,513,575 | A * | 5/1996 | Slade | 108/42 |
| 5,588,370 | A * | 12/1996 | Longley | 108/42 |
| 5,961,090 | A * | 10/1999 | Parkin | 248/475.1 |
| 6,164,610 | A * | 12/2000 | Santiago | 211/90.01 |
| 6,257,151 | B1 * | 7/2001 | Hale | 108/42 |
| 6,286,802 | B1 * | 9/2001 | Munson et al. | 248/475.1 |
| 6,467,636 | B1 * | 10/2002 | Schaefer | 211/90.01 |
| 6,591,762 | B1 * | 7/2003 | Haghayegh | 108/42 |
| 6,619,488 | B2 * | 9/2003 | Bengoechea | 108/42 |
| 7,708,252 | B2 | 5/2010 | Vander Berg et al. | |
| 8,042,700 | B1 | 10/2011 | Smalley | |
| 8,082,859 | B2 | 12/2011 | Sevack | |
| 2002/0125389 | A1 * | 9/2002 | Chu | 248/235 |
| 2006/0213848 | A1 * | 9/2006 | Kim et al. | 211/90.01 |
| 2009/0224119 | A1 | 9/2009 | Heffernan | |

OTHER PUBLICATIONS

Floating Shelf Kit; http://www.shelvingshop.com.au/shopexd.asp.
BigBoy 1150.
Danver Floating Stainless Steel Shelving; http://www.kitchensource.com/shelves/images/da-shelf-specs.jpg.

* cited by examiner

FLOATING METAL SHELF AND MOUNTING BRACKET

CROSS-REFERENCES TO RELATED APPLICATIONS

This United States non-provisional patent application is based upon and claims the filing date of U.S. provisional patent application Ser. No. 62/047,402 filed Sep. 8, 2014.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to a floating shelf and mounting bracket assembly, and more particularly to a two piece assembly that provides a safe, simple and secure mounting for a floating metal shelf affixed to a planar surface.

BACKGROUND OF THE INVENTION

Efforts to more efficiently use display and storage space using floating shelving attached to walls drives a large industry focused on providing various systems, including boxes, bins, shelves, stacking systems, and similar components. For example, the Danver floating shelf and inner frame includes bent metal tabs that protrude perpendicularly from the wall into the room. Once a shelf is mounted onto the tabs, the weight of the shelf and anything placed upon the shelf puts increased downward pressure on the tab ends. This unnecessary pressure or weight over time tends to slowly pull the screws attaching the wall bracket out of the wall.

Similarly, the BigBoy 1150 includes protruding dowel arms which require mounting hardware into the wall and solid shelving sized to receive the arms. Mounting and assembly depends upon measuring and precise location of the mounting hardware (screws).

Some floating shelf and mounting brackets include the French cleat hanger assembly, which does not lend itself readily to shelf mounting due to the requirement of the cleat element having to be held by the shelf which almost assuredly dictates a solid (and heavy) shelf which again limits the weight of anything placed upon the shelf and which tends to come away from the wall over time.

While the above examples and other known storage solutions demonstrate various approaches to exploiting use of floating shelving on existing wall space, there remain opportunities for developing improved hanging shelf storage solutions that are more easily installed, more easily leveled, and more secure.

Accordingly, there is a need for addressing problems associated with providing display floating shelving on a planar surface that is easy to assemble and install.

There is likewise a need to improve the stability of floating shelving attached to planar surfaces without the use of a wooden or metal support arm or tabs extending from the planar surface.

There is a corresponding need for an apparatus, system and/or method for floating selves and mounting bracketing that is simple, inexpensive, secure and durable.

Further it would be useful if multiple features can be incorporated into one assembly for floating shelves to provide a scalable approach for hanging a hollow floating metal shelf assembly over a range of uses.

DISCLOSURE OF INVENTION

In one aspect, the floating shelf and mounting bracket provides two parts, a hollow metal shelf and a mounting bracket. The metal shelf includes five enclosed sides. The metal shelf back side that mounts to the planar surface is partially open creating an integral mounting tab surface that allows the metal shelf to simply be lowered onto the mounting bracket that is attached to the planar surface, providing a quick and secure mounting method of the shelf without any visible brackets or hardware.

MODES FOR CARRYING OUT THE INVENTION

Figures 1, 2, 3, 4:
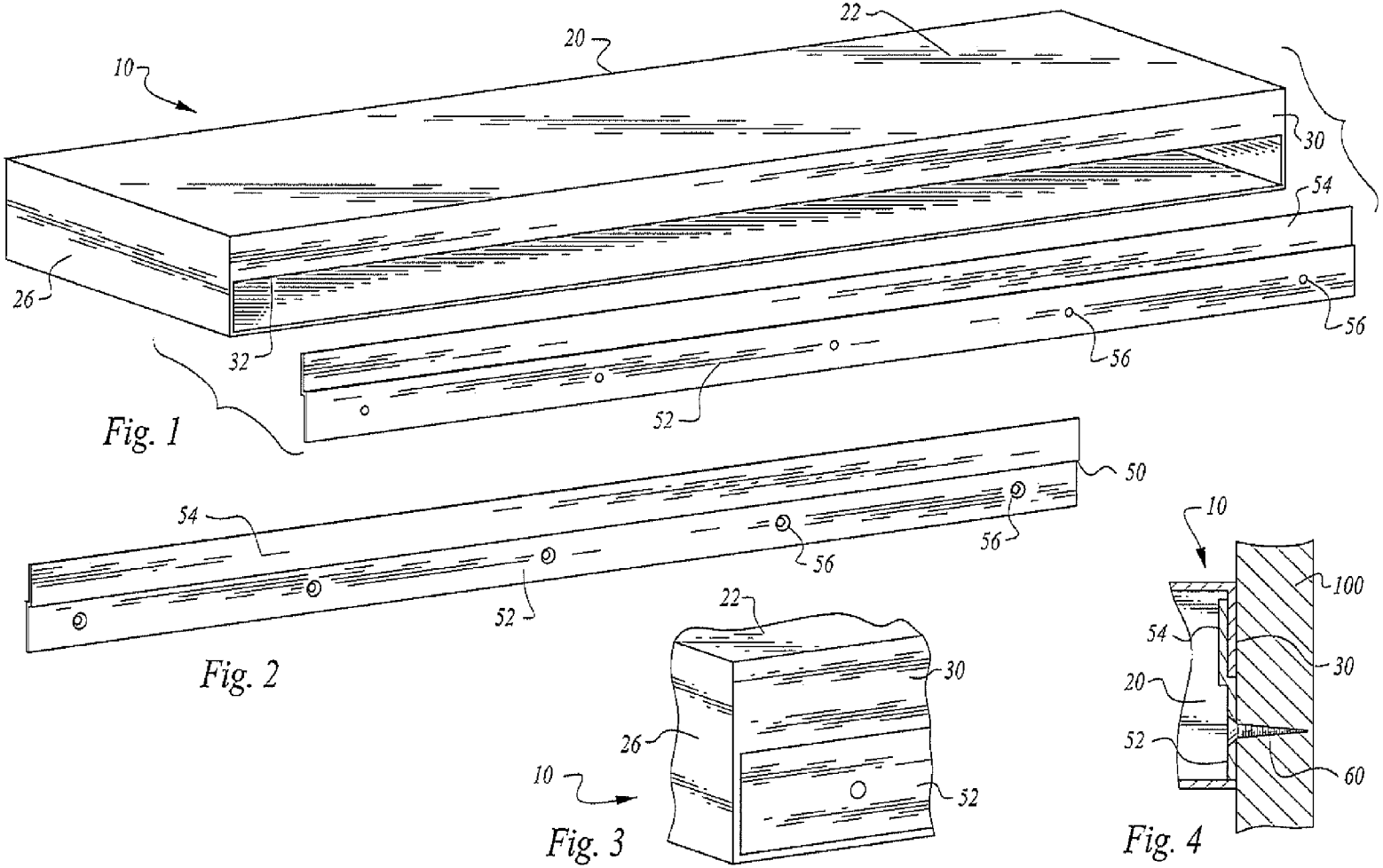
FIG. 1 depicts a top left rear perspective view of the metal shelf 20 and the metal mounting bracket 50 for an embodiment of the floating shelf and mounting bracket apparatus 10, system, and method.
FIG. 2 depicts a top left front perspective view of the metal mounting bracket 50 for the embodiment of the floating shelf and mounting bracket apparatus 10, system, and method depicted in FIG. 1.
FIG. 3 depicts a partial top rear perspective view of the metal shelf 20 fitting onto and receiving the metal mounting bracket 50 for the embodiment of the floating shelf and mounting bracket apparatus 10, system, and method depicted in FIG. 1.
FIG. 4 depicts cross sectional view of the top left rear isometric view of the metal shelf 20 fitting onto and receiving the metal mounting bracket 50 for the embodiment of the floating shelf and mounting bracket apparatus 10, system, and method depicted in FIG. 1, with one of a plurality of fasteners 60 inserted through one of the apertures 56 affixing the assembly to a planar surface 100.

One or more embodiments of the floating metal shelf and mounting bracket apparatus, system and method disclosed herein is designed to allow at least one floating metal shelf to be installed along an existing planar surface, to greatly extend the amount of usable storage without requiring additional hardware or visible brackets.

Referring to FIGS. 1-4, an embodiment of an apparatus 10, system, and method for a floating metal shelf and mounting bracket is disclosed.

An embodiment of the floating shelf and mounting bracket apparatus 10 and system includes a metal shelf 20 and a metal mounting bracket 50.

One aspect of the metal shelf 20 is rectangular and provides five enclosed sides: equal sized enclosed top and bottom sides, 22 and 24, respectively; equal sized enclosed end sides 26; and an enclosed front side. The metal shelf back side 30 is partially enclosed and further provides a uniformly spaced and sized mounting edge 32 the length of the shelf back side 30 that serves as the attachment length to correspond to the metal mounting bracket 50. The gauge of the metal used for the metal shelf 20 must be adequate to provide structural stability to the assembled metal shelf 20 and the metal mounting bracket 50. For embodiments of the floating shelf and mounting bracket apparatus and system 10 using a lighter gauge of metal for the shelf component, the inside lip of the uniformly spaced and sized mounting edge 32 of the metal shelf back side 30 is typically reinforced to assure structural stability for the apparatus 10 and system, FIGS. 1-4.

The downward load forces placed on the floating metal shelf 20 are spread evenly between the metal mounting bracket 50 and the rear edge of the metal shelf bottom side 24 that sits pressed against the planar surface, providing a much more robust and stable installation, FIG. 4.

One aspect of the metal mounting bracket 50 provides a uniform metal base 52 having a plurality of evenly spaced apertures 56 sized to receive fasteners 60 by which the uniform metal base 52 of the metal mounting bracket 50 can be affixed flush to a planar surface 100, FIG. 4. An integral offset bend 54 extends upward at a uniform height from the uniform metal base 52 for the length of the metal mounting bracket 50. The gauge of the metal for the integral offset bend 54 is adequate to carry the downward load forces from the floating metal shelf 20 communicating with the length of the integral offset bend 54 at the inside lip of the uniformly spaced and sized mounting edge 32 of the metal shelf back side 30 once the metal shelf back side 30 has been positioned onto the metal mounting bracket 50.

Referring to FIGS. 5-8, an embodiment of an apparatus 11, system, and method for a floating metal shelf and mounting bracket is disclosed.

Figures 5, 6, 7, 8:
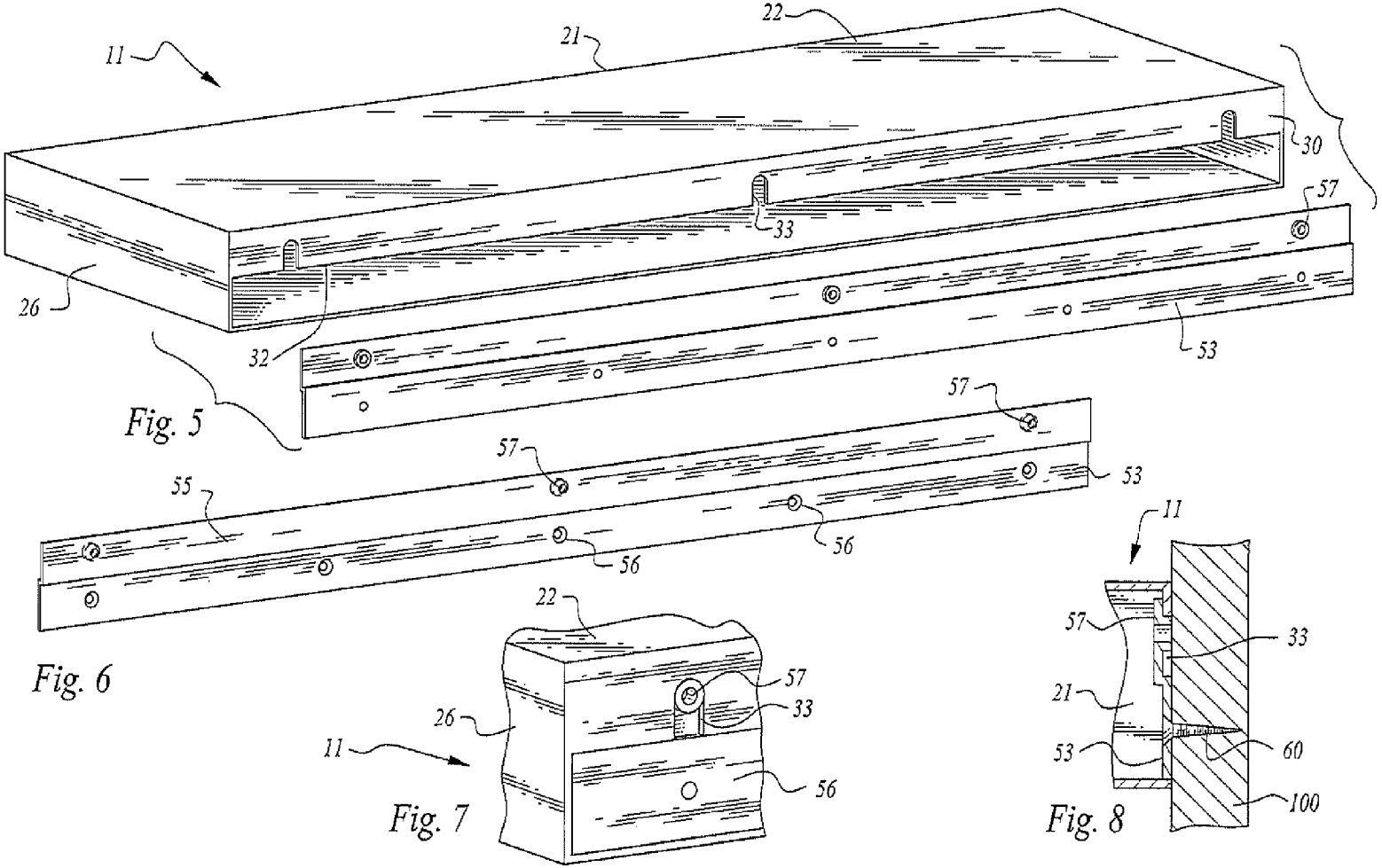
FIG. 5 depicts a top left rear perspective view of the metal shelf 21 and the metal mounting bracket 51 for an embodiment of the floating shelf and mounting bracket apparatus 11, system, and method.
FIG. 6 depicts a top left front perspective view of the metal wall mounting bracket 51 for the embodiment of the floating shelf and mounting bracket apparatus 11, system, and method depicted in FIG. 5.
FIG. 7 depicts a partial top rear perspective view of the metal shelf 21 fitting onto and receiving the metal mounting bracket 51 for the embodiment of the floating shelf and mounting bracket apparatus 11, system, and method depicted in FIG. 5.
FIG. 8 depicts cross sectional view of the top left rear isometric view of the metal shelf 21 fitting onto and receiving the metal mounting bracket 51 for the embodiment of the floating shelf and mounting bracket apparatus 11, system, and method depicted in FIG. 5, with one of a plurality of fasteners 60 inserted through one of the apertures 56 affixing the assembly to a planar surface 100.

An embodiment of the floating shelf and mounting bracket apparatus 11, system and/or method includes a metal shelf 21 and mounting bracket 51 that provides a uniform metal base 53 having a plurality of evenly spaced apertures 56 sized to receive fasteners 60 by which the uniform metal base 53 of the metal mounting bracket 50 can be affixed flush to a planar surface 100, FIG. 8. An integral offset bend 55 extends upward at a uniform height from the uniform metal base 53 for the length of the metal mounting bracket 51.

As disclosed and depicted, an embodiment of the floating shelf and mounting bracket apparatus 11 and system further includes a plurality of equal sized notched openings 33 on the metal shelf enclosed rectangular back side mounting edge 32 and a plurality of equal sized posts 57 on the front surface of the mounting bracket integral offset bend 55, whereby each rectangular back side mounting edge notched opening is sized to receive and correspond to an integral offset bend post, FIGS. 5-8. The gauge of the metal for the integral offset bend 55 is adequate to carry the downward load forces from the floating metal shelf 21 communicating with the length of the integral offset bend 55 and equal sized notched openings 33 to the top portion 30 of the bracket that correspond to the spacer posts 57 on the front surface of the mounting bracket integral offset bend 55. In this embodiment, the lateral stability of the shelf to the strip bracketing at the inside lip of the uniformly spaced and sized mounting edge 32 of the metal shelf back side 30 is increased by the notched openings 33 that correspond to the spacer posts 57 once the metal shelf back side 30 has been positioned onto the metal mounting bracket 51, FIGS. 7 and 8.

Embodiments of the floating shelf and mounting bracket apparatus, 10 and 11, and system include an apparatus, system and/or method for floating selves and mounting bracketing that are simple, inexpensive, stable, secure and durable, FIGS. 1-8.

Embodiments of the floating shelf and mounting bracket apparatus, 10 and 11, and system include an apparatus, system and/or method for floating selves and mounting bracketing that improves the security of floating shelving attached to planar surfaces without the use of a wooden or metal base extending from the planar surface, FIGS. 1-8.

Preferred embodiments of the floating shelf and mounting bracket apparatus, 10 and 11, and system include metal shelves 20 or 21 and mounting brackets 50 or 51 manufactured from steel, stainless steel, with the exterior surfaces of stainless steel shelves 20 or 21 including weathered zinc, plated brass, plated bronze, and powder coat finishes, FIGS. 1-8.

It will be recognized by persons skilled in the art that the shelving/mounting brackets for alternate embodiments of the floating shelf and mounting bracket apparatus, 10 and 11 can be manufactured from an array of high strength, lightweight materials including, without limitation, graphite, reinforced carbon-fibers, fiber-glass, or aluminum, FIGS. 1-8.

Embodiments of the floating shelf and mounting bracket apparatus, 10 and 11, and system include an apparatus, system and/or method for floating shelves and mounting bracketing that provides a scalable approach for hanging a hollow floating metal shelf assembly over a range of uses, FIGS. 1-8.

A method of use for embodiments of the floating shelf and mounting bracket apparatus, 10 and 11, and system includes at least each of the following steps:

1) providing at least one metal shelf 20 or 21 in accordance with at least one aspect of this disclosure, FIGS. 1, 5;
2) providing at least one metal mounting bracket 50 or 51 in accordance with at least one aspect of this disclosure, FIGS. 1, 5;
3) marking a level length template along a planar surface 100 at a desired height;
4) providing a plurality of fasteners, each such fastener sized to (i) fit into the at least one metal mounting bracket 50 apertures 56, and (ii) correspond to the construction materials of the planar surface 100, FIGS. 2-4, 6-8;
5) attaching at least one metal mounting bracket 50 or 51 along the marked level length template with a single fastener 60 through each metal mounting bracket 50 or 51 uniform metal base 52 or 53 aperture 56 and into the planar surface 100 such that the at least one metal mounting bracket 50 or 51 uniform metal base 52 or 53 is flush mounted level with and to the planar surface 100 and with the integral offset bend 54 or 55 extending upwards with respect to the mounted uniform metal base 52 or 53 and away from the planar surface 100, FIGS. 2-4, 6-8;
6) positioning the at least one metal shelf 20 or 21 back side 30 mounting edge 32 or 33 along the length of the integral offset bend 54 or 55 and onto the at least one metal mounting bracket 50 or 51 such that the rear edge of the metal shelf 20 or 21 bottom side 24 corresponds to and contacts the planar surface 100, and, if necessary, inserting each equal sized spacer post 57 on the mounting bracket integral offset bend 55 into an equal sized notched opening 33 on the metal shelf 21 enclosed rectangular back side mounting edge 32, FIGS. 1-2, 5-6;

7) repeating steps 1-6 until all desired floating shelf and mounting bracket apparatus assemblies 10 or 11 have been installed.

Accordingly, the floating metal shelf and mounting bracket apparatus, system and method provide the flexibility of delivering an easy to understand, simple to install, and secure assembly to hang a floating metal shelf on a planar surface. The apparatus, system and methodology of the floating metal shelf and mounting bracket apparatus, system and method alleviate the existing limitations for maintenance or repair of floating shelving assemblies. Now users will have the benefit of being able to circumvent the floating shelf maintenance and repair issues upon installation without disruption of shelving collapse or failure after installation.

We claim:

1. A floating shelf and mounting bracket assembly, comprising, in combination:

a) a hollow shelf comprising: five enclosed rectangular sides, namely equal sized enclosed top and bottom sides, equal sized enclosed end sides, and an enclosed front side; a partially enclosed rectangular back side comprising a back side top edge length conjoined to a top side rear edge length, two back side edge lengths conjoined to equal sized length portions of a rear edge for each end side and an open back side bottom edge portion providing a uniformly spaced and sized mounting edge running an entire hollow shelf back side bottom length;

b) a mounting bracket comprising a length equal to the hollow shelf back side length, an uniform base comprising a plurality of even spaced apertures, and an integral offset bend orthogonal to the mounting bracket base and then extending upward parallel to, and at an uniform height from, the mounting bracket uniform base for the entire mounting bracket length, the integral offset bend sized to receive and hold the hollow shelf back side mounting edge between the upward portion of the integral offset bend and a planar surface; and c) fastening means for affixing the mounting bracket uniform base to the planar surface through the plurality of even spaced apertures;

whereby once the hollow shelf back side has been positioned onto the mounting bracket offset bend, the hollow shelf back side is flush with the planar surface and load forces placed on the hollow shelf top surface are spread evenly between the mounting bracket and a rear edge of the hollow shelf bottom side that contacts the planar surface.

2. The floating shelf and mounting bracket assembly of claim 1 further comprising a plurality of equal sized notched openings on the shelf enclosed rectangular back side mounting edge, each notched opening comprising a channel from the open back side bottom edge portion, and a plurality of equal sized spacer posts on an inside surface of the mounting bracket integral offset bend, whereby each rectangular back side mounting edge notched opening channel is sized to receive and correspond to an integral offset bend spacer post.

3. The floating shelf and mounting bracket assembly of claim 2 wherein the shelf and mounting bracket are manufactured from materials consisting of steel, stainless steel, graphite, reinforced carbon-fibers, fiber-glass, and aluminum.

4. The floating shelf and mounting bracket assembly of claim 3 wherein external side surfaces of a hollow stainless steel shelf are polished finishes selected from the list consisting of weathered zinc, plated brass, plated bronze, and powder coat finishes.

5. A floating shelf and mounting bracket assembly, comprising, in combination;

a) a hollow stainless steel shelf comprising: five enclosed rectangular sides, namely equal sized enclosed top and bottom sides, equal sized enclosed end sides, and an enclosed front side; a partially enclosed rectangular back side comprising a back side top edge length conjoined to a top side rear edge length, two back side edge lengths conjoined to equal sized length portions of a rear edge for each end side and an open back side bottom edge portion providing a uniformly spaced and sized mounting edge running an entire hollow shelf back side bottom length;

b) a stainless steel mounting bracket comprising a length equal to the hollow shelf back side length, an uniform base comprising a plurality of even spaced apertures, and an integral offset bend orthogonal to the mounting bracket base and then extending upward parallel to, and at an uniform height from, the mounting bracket uniform base for the entire mounting bracket length, the integral offset bend sized to receive and hold the hollow shelf back side mounting edge between the upward portion of the integral offset bend and a planar surface; and c) fastening means for affixing the mounting bracket uniform base to the planar surface through the plurality of even spaced apertures;

whereby once the hollow shelf back side has been positioned onto the mounting bracket offset bend, the hollow shelf back side is flush with the planar surface and load forces placed on the hollow shelf top surface are spread evenly between the mounting bracket and a rear edge of the hollow shelf bottom side that contacts the planar surface.

6. The floating shelf and mounting bracket assembly of claim 5 further comprising a plurality of equal sized notched openings on the hollow stainless steel shelf enclosed rectangular back side mounting edge, each notched opening comprising a channel from the open back side bottom edge portion, and a plurality of equal sized spacer posts on an inside surface of the mounting bracket integral offset bend, whereby each rectangular back side mounting edge notched opening channel is sized to receive and correspond to an integral offset bend spacer post.

7. The floating shelf and mounting bracket assembly of claim 6 wherein external side surfaces of the hollow stainless steel shelf are polished finishes selected from the list consisting of weathered zinc, plated brass, plated bronze, and powder coat finishes.

8. A method of installing a floating shelf onto a vertically disposed planar surface, the method comprising the steps of:

a) providing at least one shelf in accordance with claim 1;

b) providing at least one mounting bracket in accordance with claim 1;

c) marking a level length template along a planar surface at a desired height;

d) providing a plurality of fasteners, each such fastener sized to (i) fit into the at least one mounting bracket apertures, and (ii) correspond to the construction materials of the planar surface;

e) attaching at least one mounting bracket along the marked level length template with a single fastener through each metal mounting bracket uniform base aperture and into the planar surface such that the at least one mounting bracket is mounted level with and to the planar surface, and with the mounting bracket integral offset extending upwards with respect to the mounting bracket uniform base and away from the planar surface;

f) positioning the at least one shelf back side mounting edge along the length of the integral offset bend and onto the at least one metal mounting bracket such that the shelf back side is flush with the planar surface and the rear edge of the shelf bottom side corresponds to and contacts the planar surface, and, if necessary, inserting each equal sized spacer posts on the mounting bracket integral offset bend into an equal sized notched opening on the shelf enclosed rectangular back side mounting edge;

g) repeating steps a)-f) until all desired floating shelf and mounting bracket apparatus assemblies have been installed.

* * * * *

UNITED STATES PATENT AND TRADEMARK OFFICE

CERTIFICATE OF CORRECTION

PATENT NO. : 9,185,979 B1
APPLICATION NO. : 14/695314
DATED : November 17, 2015
INVENTOR(S) : Jenks et al.

It is certified that error appears in the above-identified patent and that said Letters Patent is hereby corrected as shown below:

On the title page (73) Assignee, delete "Pilgrim Home and Health Alliance, LLC" insert -- Pilgrim Home and Hearth Alliance, LLC --

Signed and Sealed this
Eighth Day of March, 2016

Michelle K. Lee

Michelle K. Lee
*Director of the United States Patent and Trademark Office*